United States Patent [19]

Crosby

[11] Patent Number: 4,577,765

[45] Date of Patent: Mar. 25, 1986

[54] WINE RACK

[76] Inventor: Terry R. Crosby, 7237 Cotton Plant Cv., Memphis, Tenn. 38119

[21] Appl. No.: 737,181

[22] Filed: May 23, 1985

[51] Int. Cl.[4] ..... A47B 73/00

[52] U.S. Cl. ..... 211/75; D7/71; 211/86

[58] Field of Search ..... 211/75, 71, 86, 87, 211/89, 13; 206/479, 478, 477, 488; D6/553, 567, 569, 513, 514; D7/71

[56] References Cited

U.S. PATENT DOCUMENTS

| | | | |
|---|---|---|---|
| D. 243,738 | 3/1977 | Johnson | D7/71 |
| 235,103 | 12/1880 | Sherman | 211/71 X |
| 665,800 | 1/1901 | Reno . | |
| 2,580,676 | 1/1952 | Gross | 211/75 |
| 3,181,704 | 5/1965 | Thomas | 211/71 X |
| 3,259,249 | 7/1966 | Arts | 211/75 |
| 3,647,072 | 3/1972 | Strang | 211/4 |
| 3,690,130 | 9/1972 | Eutzler | 211/4 X |
| 3,746,179 | 7/1973 | Paumgardhen | 211/75 |
| 4,120,401 | 10/1978 | Newman . | |

*Primary Examiner*—Ramon S. Britts
*Assistant Examiner*—Sarah A. Lechok Eley
*Attorney, Agent, or Firm*—Walker & McKenzie

[57] ABSTRACT

A wine rack for horizontally supporting a plurality of wine bottles. The wine bottles are mounted in a manner as to allow the wine and labels to be clearly viewed without disturbing the wine bottle. The wine rack allows the wine bottles to be easily removed or easily installed on the rack.

8 Claims, 4 Drawing Figures

WINE RACK

BACKGROUND OF THE INVENTION

1. Field of the Invention

The present invention relates to a rack for horizontally cradling wine bottles or the like.

2. Description of the Prior Art

Various devices have heretofore been developed that relate to bottle holders and the like. See, for example, Irwin, U.S. Pat. No. 1,014,004; Paumgardhen, U.S. Pat. No. 3,746,179; and Nogle, U.S. Pat. No. 2,577,713. None of the above patents disclose or suggest the present invention.

SUMMARY OF THE INVENTION

The present invention is directed toward providing an improved rack in which wine bottles are horizontally mounted in a manner to easily view the wine and to read the labels thereon.

The wine rack of the present invention comprises, in general, an elongated body member and a plurality of holding means for wine bottles with each of said holding means including: a flexible member having first and second ends and a midsection; securement means for securing the midsection of the flexible member to the front of the body member; and retracting means fixedly attached to the first and second ends of the flexible member for providing a greater gravitational force thereon.

One of the objects of the present invention is to display the wine bottles without blocking the view of the wine or the labels.

A further object is to provide a wine rack wherein the wine bottles are easily and conveniently removed or installed thereto.

A further object is to provide a wine rack that will cradle various sizes of bottles.

DESCRIPTION OF THE PREFERRED EMBODIMENT

Figure 1:
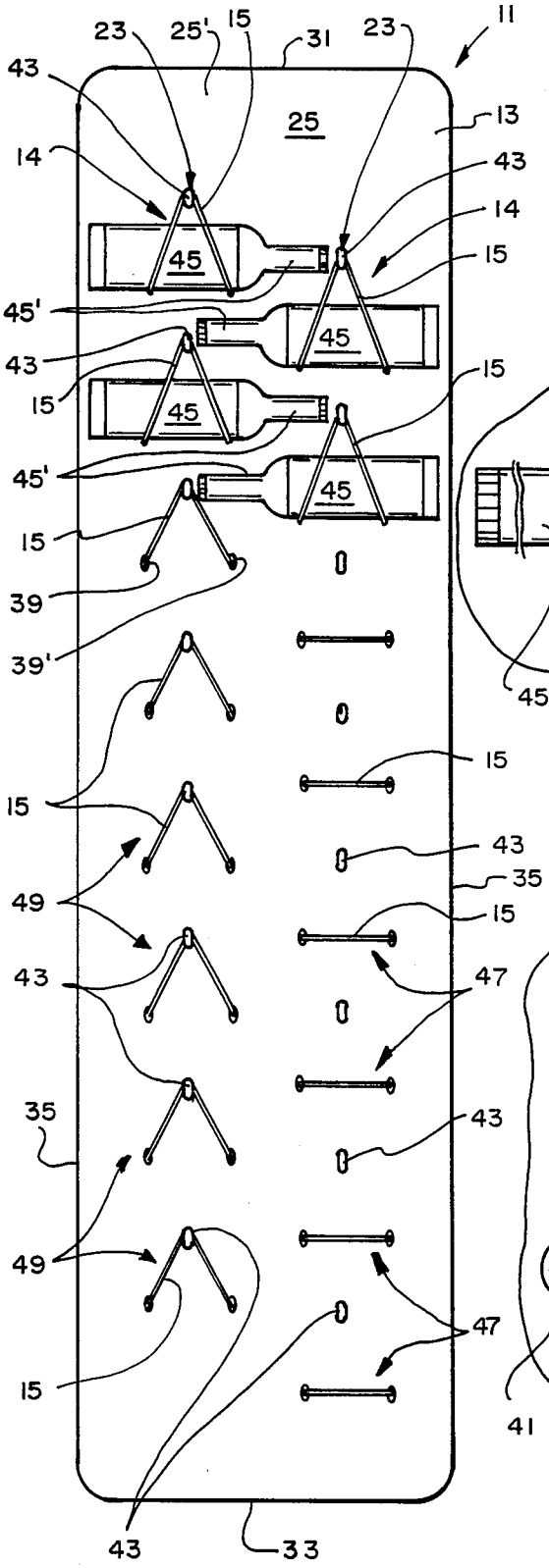
FIG. 1 is a front elevational view of the wine rack of the present invention showing a plurality of wine bottles removably cradled on the top portion of the rack.

The wine rack 11 of the present invention includes, in general, an elongated body member 13 and at least one but preferably a plurality of wine bottle holding means 14. Each of said holding means 14 includes a flexible member 15 for cradling a wine bottle thereon and having a first end 17, a second end 19 and a midsection 21, a securement means 23 for securing the midsection 21 of the flexible member 15 to the front 25 of the body member 13; and a retracting means 27 fixedly attached to the first and second ends 17, 19 of the flexible member 15 for providing a greater gravitational pull thereon.

The body member 13 includes an elongated board-like front wall 25, a removable back wall 29 (see FIG. 4), a top wall 31, a bottom wall 33 and two side walls 35. The front wall 25, bottom wall 33, top wall 31 and side walls 35 are preferably integrally attached along the adjoining edges thereof to establish body member 13 and to define the interior 37 of the body member 13. The removable back wall 29 has substantially the same length and width relative to the front wall 25 and is fixedly attached to the rearward distal edges of the top wall 31, bottom wall 33 and side walls 35 in any manner well known to those skilled in the art, i.e., such as screws or the like.

Each of holding means 14 and its related components of wine rack 11 are substantially identical and the following description of one will suffice for all.

The flexible member 15 (see FIGS. 2, 3 and 4) is preferably formed from an elongated substantially small linked chain or the like of the type well known to those skilled in the art. The midsection 21 of flexible member 15 is disposed on the front or outer side 25' of the front wall 25 of the body member 13 with the first end 17 and second end 19 extending downwardly through apertures 39, 39' into the interior 37 in adjacency with the back side 25'' of front wall 25. The apertures 39 and 39' extend through front wall 25 and are horizontally spaced apart. Apertures 39 and 39' are disposed at a 45° angle relative to the front side 25' of the body member 13.

The retracting means 27 includes a substantially elongated weight 40 or the like having hooks 41, 41' extending outwardly from the ends thereof. The hook 41 is engaged with the first end 17 of the flexible member 15 and the hook 41' is engaged with the second end 19 of the flexible member (see FIG. 3). The first end 17 and second end 19 of the flexible member 15 with the attached weight 40 are enclosed within the interior 37 of the wine rack 11 (see FIGS. 3 and 4). The weight 40 substantially increases the downwardly gravitational force against the flexible member 15.

The securement means 23 includes a hook means and an attachment means integrally attached to said hook means. The hook means comprises a hook 43 or the like and the attachment means comprises a screw 43' integrally attached to the hook 43 (see FIG. 4). The securement means 23 is fixedly attached to the front side 25' of the front wall 25 of the body member 13 and is disposed in a position on front side 25' which is spaced above the apertures 39, 39' along an imaginary vertical line substantially halfway between apertures 39, 39' (see FIGS. 1 and 2).

Illustrated in FIG. 1 of the drawings, the holding means 14 are disposed on the front wall 25 in a staggered position so as to allow the wine bottles 45 to be placed in staggered positions. Thus, the first wine bottle 45 is positioned with the neck 45' facing to the right and the next bottle 45 disposed therebelow has the neck 45' facing to the left, and continuing in that manner down the wine rack 11.

Figure 2:
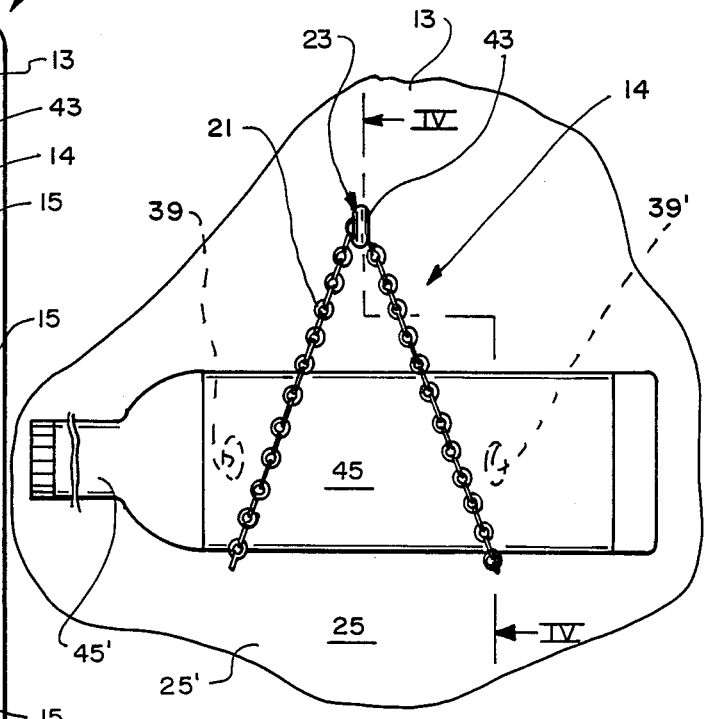
FIG. 2 is substantially an enlarged front elevational view of a single wine bottle cradled on the wine rack.
Figure 3:
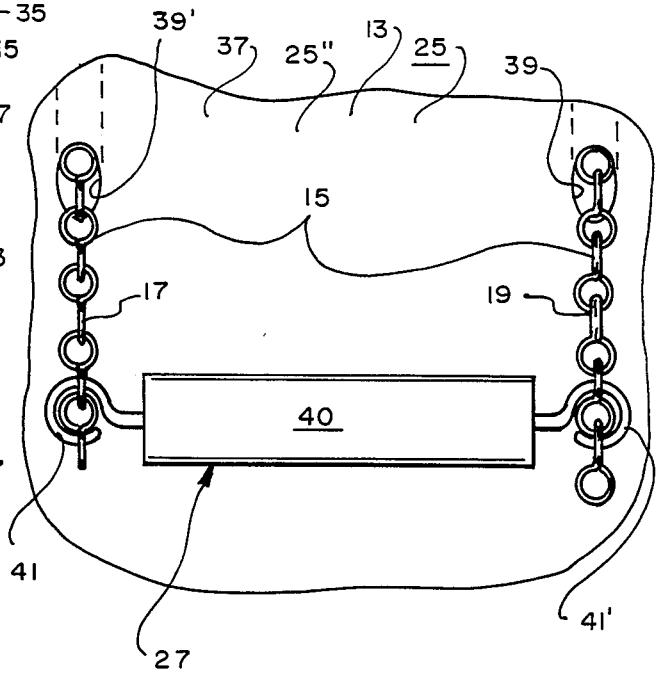
FIG. 3 is an enlarged view of the first and second ends of one of the chains with the weight attached thereon.
Figure 4:
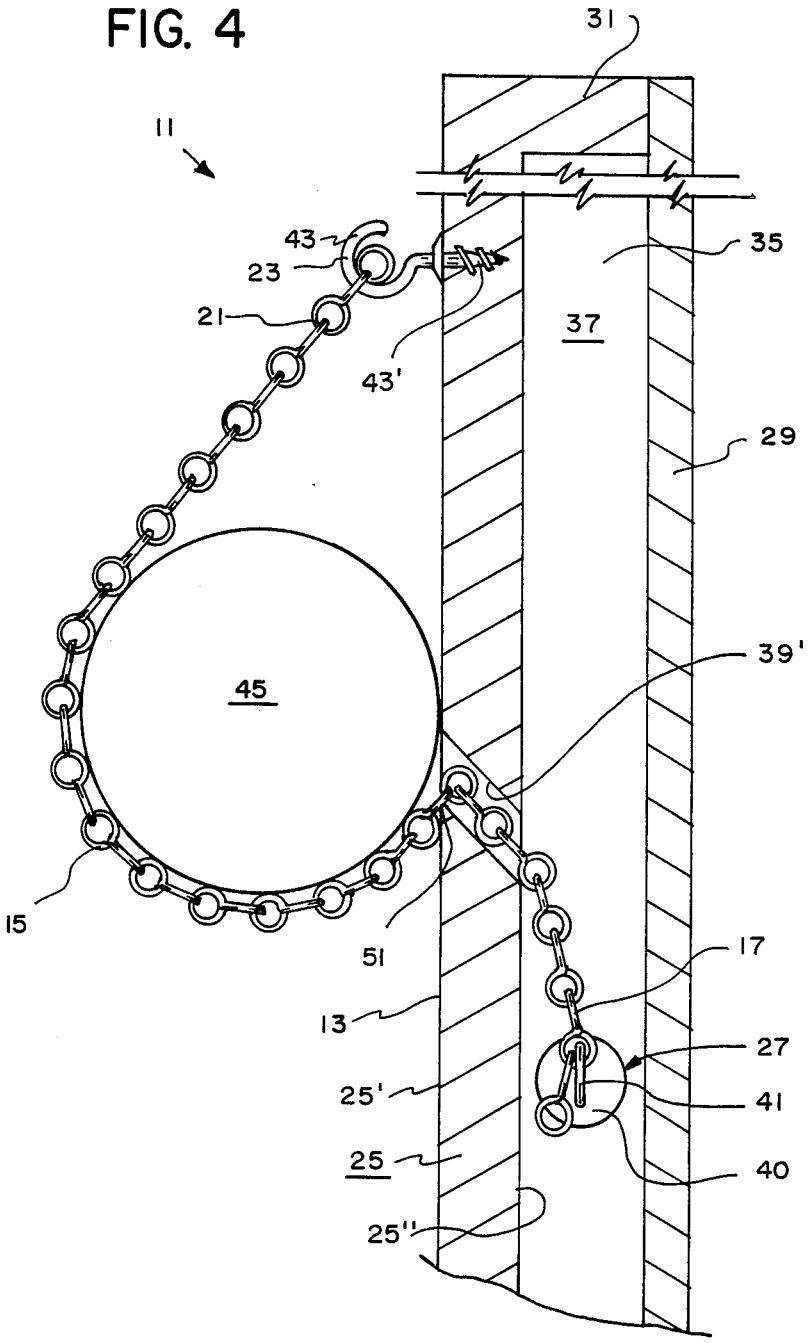
FIG. 4 is an enlarged sectional view substantially as taken on line IV—IV of FIG. 2.

The operation of the wine rack 11 of the present invention is quite simple. The bottle 45 is merely positioned with the neck 45' facing the middle of the body member 13 and is substantially centrally disposed between the hook 43 and the apertures 39 and 39'. Then, the midsection 21 of the flexible member 15 is pulled outwardly from the body member 13, placed around the bottle 45 and engaged in the hook 43 (see FIG. 4). The subsequent releasing of the bottle 45 allows the flexible member 15 to cradle the bottle 45 in a position substantially as shown in FIGS. 1, 2 and 4. To remove the bottle 45 from the wine rack 11, one may simply grasp the bottle 45 and remove the flexible member 15 off the hook 43, which allows the weight 40 to retract the flexible member 15 to a retracted position 47 shown in FIG. 1 or the bottle 45 may be simply slid end wise allowing the weight 40 to retract the flexible member 15 to a retracted position 49 also shown in FIG. 1. It will be understood that the angle of the apertures 39, 39' permits the flexible member 15 when released to slide easily through apertures 39,39' so that the flexible member 15 is returned to the position shown as at 47 or 49 under the influence of the weight 40. Also, it will be understood that the weight 40 may be adjusted along the length of flexible member 15 to accommodate variations in bottle sizes, if necessary, although in most instances it would not be necessary. Additionally, it will be understood that the weight 40 may be adjusted to a position closer to apertures 39, 39' so as to act as a stop for the flexible member 15 when a bottle is being held, but with enough slack in the flexible member 15 being preferably provided so that the flexible member 15 can be unhooked from hook 43. However, this slack is not necessary if the bottle is slid end wise into place without unhooking the flexible member. Further, it will be understood that if the weight 40 is sufficiently large, it is not necessary for the weight to act as a stop, particularly with the resistive action of the junctures 51 where apertures 39, 39' meet the front side 25' of front wall 25.

The wine rack 11 of the present invention provides a sturdy, decorative wine rack on which a plurality of wine bottles 45 may be mounted. The wine bottles 45 are placed in a horizontal position allowing the cork to be kept moist therefore keeping the seal thereon. The wine rack 11 also allows one to view the wine and to read the labels without handling and disturbing the bottles 45.

The wine rack 11 may be hung on the wall by means of eyelets (not shown) installed on the back 29 in any manner as you would hang a picture or the wine rack 11 may be placed on the floor or the like and leaned against a wall. The wine rack 11 is small enough to be used in a home, an apartment or may be used as a display in a store. The wine rack 11 provides a decorative piece of hand craft that will enhance any surrounding.

Although the present invention has been described and illustrated with respect to a preferred embodiment thereof and a preferred use therefore, it is not to be so limited since changes and modifications can be made therein which are within the full intended scope of the invention.

I claim:

1. A rack for displaying at least one bottle or the like comprising:

(a) a body member including a front wall having at least a pair of apertures therethrough, said front wall having a front side and a back side;

(b) an elongated flexible member movably extending through a pair of said apertures to provide a bight portion disposed adjacent said front side of said front wall and to provide a portion of said flexible member disposed adjacent said back side of said front wall;

(c) securement means attached to said body member for securing a portion of said bight portion of said flexible member to said body member and for causing said bight portion to form a pair of cradle portions for stably and removably cradling a bottle; and (d) means attached to said portion of said flexible member adjacent said back side of said front wall for limiting movement of said flexible member through said apertures in a direction from said back side to said front side of said front wall.

2. A wine rack for displaying wine bottles or the like comprising:

(a) a body member including a front wall having at least a pair of apertures therethrough, said front wall having a front side and a back side;

(b) an elongated flexible member movably extending through a pair of said apertures to provide a bight portion disposed adjaecnt said front side of said front wall for removably cradling a wine bottle and to provide a portion of said flexible member disposed adjacent said back side of said front wall;

(c) securement means attached to said body member on said front side of said front wall in spaced relationship above said apertures for removably securing said bight portion of said flexible member; and (d) retracting means attached to said portion of said flexible member adjacent said back side of said front wall for urging said flexible member through said apertures in a direction from said front side to said back side of said front wall.

3. A wine rack for displaying wine bottles or the like comprising:

(a) a body member including a front wall having at least a pair of apertures therethrough, said front wall having a front side and a back side;

(b) an elongated flexible member movably extending through a pair of said apertures to provide a bight portion disposed adjacent said front side of said front wall for removably cradling a wine bottle and to provide a portion of said flexible member disposed adjacent said back side of said front wall;

(c) securement means attached to said body member on said front side of said front wall for removably securing said bight portion of said flexible member; and (d) retracting means attached to said portion of said flexible member adjacent said back side of said front wall for urging said flexible member through said apertures in a direction from said front side to said back side of said front wall, said retracting means comprising a weight including hook means at opposite ends thereof removably attached to said flexible member.

4. A wine rack for displaying wine bottles or the like comprising:

(a) a body member including a front wall having at least a pair of apertures therethrough, said front wall having a front side and a back side, being disposed at an angle extending downwardly from said front side towards said back side of said front wall;

(b) an elongated flexible member movably extending through a pair of said apertures to provide a bight portion disposed adjacent said front side of said front wall for removably cradling a wine bottle and to provide a portion of said flexible member disposed adjacent said back side of said front wall;

(c) securement means attached to said body member on said front side of said front wall for removably securing said bight portion of said flexible member; and (d) retracting means attached to said portion of said flexible member adjacent said back side of said front wall for urging said flexible member through said apertures in a direction from said front side to said back side of said front wall.

5. The wine rack of claim 4 in which said apertures are disposed at substantially a 45° angle relative to said front side.

6. The wine rack of claim 5 in which said body member includes a removable back wall and in which said body member is provided with an interior which is accessible by the removal of said back wall.

7. The wine rack of claim 6 in which said weight and the portion of said flexible member adjacent said back side of said front wall is disposed in said interior.

8. The wine rack of claim 7 in which said securement means comprises a hook attached to said front wall at a position on said front side thereof which is spaced above said apertures.

* * * * *